US010190761B1

(12) United States Patent
Winters et al.

(10) Patent No.: US 10,190,761 B1
(45) Date of Patent: Jan. 29, 2019

(54) ADAPTERS FOR EXISTING LIGHT FIXTURES

(71) Applicant: Cooper Technologies Company, Houston, TX (US)

(72) Inventors: Philip D. Winters, Senoia, GA (US); Jyoti Kumar, Smyrna, GA (US); Bryant A. Bilal, Atlanta, GA (US); Seth Doheny, Newman, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/624,870

(22) Filed: Jun. 16, 2017

(51) Int. Cl.

| | |
|---|---|
| ***H05B 37/02*** | (2006.01) |
| ***F21V 23/06*** | (2006.01) |
| ***F21V 23/02*** | (2006.01) |
| ***F21V 23/00*** | (2015.01) |

(52) U.S. Cl.
CPC ..... *F21V 23/06* (2013.01); *F21V 23/001* (2013.01); *F21V 23/02* (2013.01); *H05B 37/0272* (2013.01); *H05B 37/0281* (2013.01)

(58) Field of Classification Search
CPC ..... F21V 23/06; F21V 23/001; F21V 23/02; H05B 37/0272; H05B 37/0281
USPC ..... 362/231, 249.01, 255; 315/307
See application file for complete search history.

(56) References Cited

U.S. PATENT DOCUMENTS

| | | | |
|---|---|---|---|
| 6,388,399 | B1 | 5/2002 | Eckel |
| 7,123,140 | B1 | 10/2006 | Denes |
| 8,222,832 | B2 | 7/2012 | Zheng |
| 8,415,901 | B2 * | 4/2013 | Recker ..... H05B 33/0803 315/172 |
| 8,492,984 | B2 | 7/2013 | Deurenberg |
| 8,643,304 | B2 | 2/2014 | Hamel |
| 8,941,304 | B2 | 1/2015 | Goscha |
| 2003/0209999 | A1 | 11/2003 | Hui |
| 2006/0044152 | A1 | 3/2006 | Wang |
| 2006/0244622 | A1 | 11/2006 | Wray |
| 2007/0247086 | A1 | 10/2007 | Chiu |
| 2007/0291483 | A1 | 12/2007 | Lys |
| 2010/0118148 | A1 | 5/2010 | Lee |
| 2010/0204847 | A1 | 8/2010 | Leete |
| 2010/0301781 | A1 | 12/2010 | Budike |
| 2011/0006658 | A1 | 1/2011 | Chan |
| 2011/0184577 | A1 | 7/2011 | Ilyes |

(Continued)

OTHER PUBLICATIONS

International Search Report for application No. PCT/US2016/024006 dated Jun. 30, 2016.

(Continued)

*Primary Examiner* — Douglas W Owens
*Assistant Examiner* — Syed M Kaiser
(74) *Attorney, Agent, or Firm* — King & Spalding LLP

(57) ABSTRACT

A retrofitted light fixture can include a power source that delivers primary power. The retrofitted light fixture can also include at least one light fixture component of an existing light fixture, where the at least one light fixture component, as part of the existing light fixture, was directly coupled to the power source. The retrofitted light fixture can further include an adapter coupled to the power supply and the at least one light source, where the adapter comprises a controller, where the adapter receives the primary power from the power source, where the controller delivers power to the at least one light fixture component based on instructions.

20 Claims, 6 Drawing Sheets

(56) References Cited

U.S. PATENT DOCUMENTS

2011/0204820 A1 8/2011 Tikkanen et al.
2011/0234104 A1 9/2011 Mishima
2012/0112654 A1 5/2012 Choong
2012/0139426 A1 6/2012 Ilyes
2012/0181935 A1 7/2012 Velazquez
2013/0076270 A1 3/2013 Alexandrovich
2013/0094207 A1 4/2013 Negandhi
2013/0187552 A1 7/2013 Frodsham
2013/0257284 A1 10/2013 Vanwagoner
2013/0271004 A1 10/2013 Min
2013/0342131 A1* 12/2013 Recker ..... H05B 33/0842 315/292
2014/0001952 A1 1/2014 Harris
2014/0001962 A1 1/2014 Harris
2014/0028200 A1 1/2014 Van Wagoner et al.
2014/0049972 A1 2/2014 McGuire
2014/0062334 A1 3/2014 Nagazoe
2014/0070707 A1 3/2014 Nagazoe
2014/0265880 A1 9/2014 Taipale
2014/0268722 A1* 9/2014 Holland ..... F21V 21/096 362/218
2014/0268733 A1* 9/2014 Holland ..... F21V 21/096 362/231
2014/0300293 A1 10/2014 Ruan
2015/0015152 A1 1/2015 Aboulnaga
2015/0198324 A1 7/2015 O'Brien
2016/0014867 A1 1/2016 Luk
2016/0057837 A1 2/2016 Brand
2016/0128158 A1 5/2016 Harder
2016/0165659 A1 6/2016 Deng
2016/0255697 A1 9/2016 Bhide
2016/0273717 A1* 9/2016 Krames ..... G02B 6/0073
2016/0330825 A1* 11/2016 Recker ..... H05B 37/0272
2016/0370535 A1* 12/2016 Boomgaarden ..... F21K 9/23
2017/0105272 A1 4/2017 Johnson
2017/0139108 A1* 5/2017 Boomgaarden ..... G02B 6/0041
2017/0307143 A1 10/2017 Shah

OTHER PUBLICATIONS

Casambi CBU-TED, Fact sheet, Mar. 7, 2015.
Office Action for U.S. Appl. No. 15/784,977 dated Nov. 28, 2018.

* cited by examiner

ADAPTERS FOR EXISTING LIGHT FIXTURES

TECHNICAL FIELD

The present disclosure relates generally to control systems for light fixtures, and more particularly to systems, methods, and devices for adapters for existing light fixtures.

BACKGROUND

Many existing light fixtures that are installed in a building, home, or other structure have been in place for years. A number of these light fixtures were manufactured and installed before many of the technological advancements in light fixtures evolved. For example, a number of these light fixtures can only be manually controlled, while many of the recent light fixtures allow for remote user control. Replacing the existing light fixtures to upgrade to the new technologies can be an expensive proposition that may not have enough of a benefit for a user to replace the existing light fixtures.

SUMMARY

In general, in one aspect, the disclosure relates to a retrofitted light fixture that can include a coupling feature of a power source that delivers primary power. The retrofitted light fixture can also include at least one light fixture component of an existing light fixture, where the at least one light fixture component includes a power supply, where the at least one light fixture component, as part of the existing light fixture, was directly coupled to the power source. The retrofitted light fixture can further include an adapter coupled to the coupling feature of the power source and the power supply of the at least one light fixture component, where the adapter includes a controller, where the adapter receives the primary power from the coupling feature of the power source, where the controller delivers power to the power supply of the at least one light fixture component based on instructions.

In another aspect, the disclosure can generally relate to an adapter for retrofitting an existing light fixture. The adapter can include a first coupling feature configured to couple to a power source that provides primary power. The adapter can also include a second coupling feature configured to couple to a power supply of the existing light fixture. The adapter can further include an adapter housing coupled to and disposed between the first coupling feature and the second coupling feature. The adapter housing includes a controller that can be configured to receive the primary power from the power source through the first connector end, and to deliver, using instructions, power based on the primary power to at least one light fixture component of the existing light fixture.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION

Figure 1A:
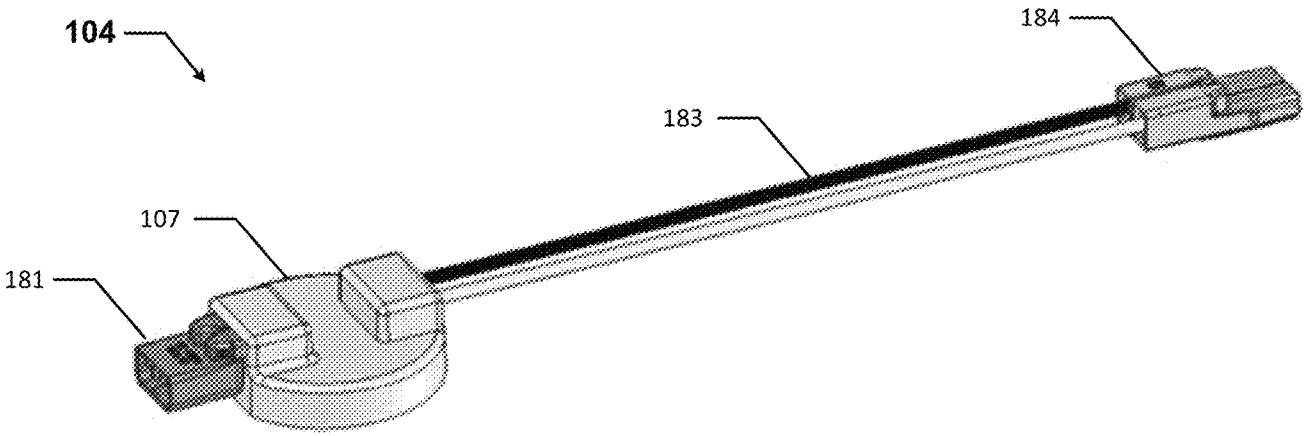
FIGS. 1A-1E show various views of an adapter in accordance with certain example embodiments.

In general, example embodiments provide systems, methods, and devices for adapters for existing light fixtures. Example adapters for existing light fixtures provide a number of benefits. Such benefits can include, but are not limited to, prolonging the life and functionality of an existing light fixture, increased reliability of the light fixture, reduced power consumption, improved communication efficiency, ease of installation, ease of maintenance, and compliance with industry standards that apply to light fixtures located in certain environments. The term "light fixture" is sometimes abbreviated as "LF" herein.

Generally speaking, this application is directed to an adapter for an existing light fixture that allows the light fixture to transform from a "dumb" light fixture to a "smart" light fixture. The specific examples provided herein are directed to an existing light fixture that cannot be remotely controlled in its current state, where the adapter can easily be installed, often without the use of tools, to allow the retrofitted light fixture to be remotely and wirelessly controlled. However, it is contemplated herein that adapters can be used with other types of devices. Examples of other types of devices can include, but are not limited to, a camera, a computer, and a sensor device. Therefore, example embodiments can be used with any type of device and are not specifically limited to use with light fixtures.

Existing light fixtures with which example adapters can be used can be located in one or more of any of a number of environments. Examples of such environments can include, but are not limited to, indoors, outdoors, office space, manufacturing plant, warehouse, storage, climate-controlled, and non-climate-controlled. In some cases, the example embodiments discussed herein can be used in any type of hazardous environment, including but not limited to an airplane hangar, a drilling rig (as for oil, gas, or water), a production rig (as for oil or gas), a refinery, a chemical plant, a power plant, a mining operation, a wastewater treatment facility, and a steel mill. A user may be any person that interacts with existing light fixtures and/or example adapters. Examples of a user may include, but are not limited to, an engineer, an electrician, an instrumentation and controls technician, a mechanic, an operator, a property manager, a homeowner, a tenant, an employee, a consultant, a contractor, and a manufacturer's representative.

The existing light fixtures with example adapters (including components thereof) can be made of one or more of a number of suitable materials to allow the light fixture to meet certain standards and/or regulations while also maintaining durability in light of the one or more conditions under which the light fixtures and/or other associated components of the light fixture can be exposed. Examples of such materials can include, but are not limited to, aluminum, stainless steel, fiberglass, glass, plastic, ceramic, and rubber.

Existing light fixtures with example adapters, or portions thereof, described herein can be made from a single piece (as from a mold, injection mold, die cast, or extrusion process). In addition, or in the alternative, existing light fixtures with example adapters can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, snap fittings, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, abutting, in communication with, or other similar terms. Such terms are merely meant to distinguish various elements and/or features within a component or device and are not meant to limit the capability or function of that particular element and/or feature. For example, a feature described as a "coupling feature" can couple, secure, fasten, abut against, and/or perform other functions aside from merely coupling.

A coupling feature (including a complementary coupling feature) as described herein can allow one or more components and/or portions of an example adapter to become coupled, directly or indirectly, to a portion of an existing light fixture. A coupling feature can include, but is not limited to, a clamp, a portion of a hinge, an aperture, a recessed area, a protrusion, a hole, a slot, a tab, a detent, and mating threads. One portion of an example adapter can be coupled to a portion of an existing light fixture by the direct use of one or more coupling features.

In addition, or in the alternative, a portion of an example adapter can be coupled to a portion of an existing light fixture using one or more independent devices that interact with one or more coupling features disposed on a component of the adapter. Examples of such devices can include, but are not limited to, a pin, a hinge, a fastening device (e.g., a bolt, a screw, a rivet), epoxy, glue, adhesive, and a spring. One coupling feature described herein can be the same as, or different than, one or more other coupling features described herein. A complementary coupling feature as described herein can be a coupling feature that mechanically couples, directly or indirectly, with another coupling feature.

In the foregoing figures showing example embodiments of adapters for existing light fixtures, one or more of the components shown may be omitted, repeated, and/or substituted. Accordingly, example embodiments of adapters for existing light fixtures should not be considered limited to the specific arrangements of components shown in any of the figures. For example, features shown in one or more figures or described with respect to one embodiment can be applied to another embodiment associated with a different figure or description.

In certain example embodiments, retrofitted light fixtures having example adapters are subject to meeting certain standards and/or requirements. For example, the National Electric Code (NEC), the National Electrical Manufacturers Association (NEMA), the International Electrotechnical Commission (IEC), the Federal Communication Commission (FCC), Underwriters Laboratories (UL), and the Institute of Electrical and Electronics Engineers (IEEE) set standards as to electrical enclosures, wiring, and electrical connections. Use of example embodiments described herein meet (and/or allow the retrofitted light fixture to meet) such standards when applicable.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number, and corresponding components in other figures have the identical last two digits.

In addition, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of adapters for existing light fixtures will be described more fully hereinafter with reference to the accompanying drawings, in which example embodiments of adapters for existing light fixtures are shown. Adapters for existing light fixtures may, however, be embodied in many different forms and should not be construed as limited to the example embodiments set forth herein. Rather, these example embodiments are provided so that this disclosure will be thorough and complete, and will fully convey the scope of adapters for existing light fixtures to those of ordinary skill in the art. Like, but not necessarily the same, elements (also sometimes called components) in the various figures are denoted by like reference numerals for consistency.

Terms such as "first", "second", "above", "below", "distal", "proximal", "end", "top", "bottom", "side", and "within" are used merely to distinguish one component (or part of a component or state of a component) from another. Such terms are not meant to denote a preference or a particular orientation, and are not meant to limit embodiments of adapters for existing light fixtures. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1B:
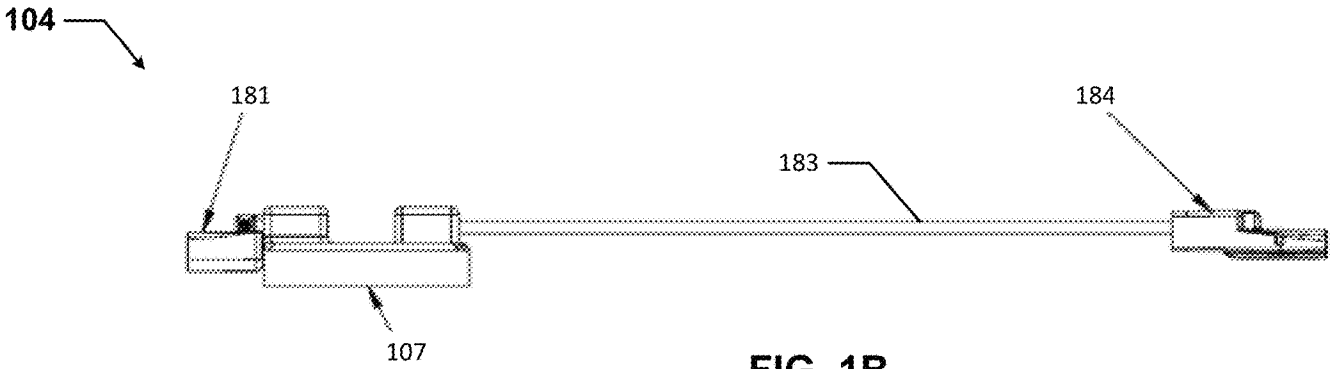
Figure 1C:
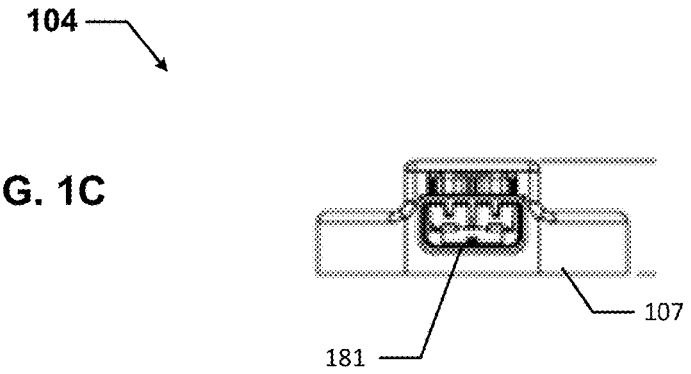
Figure 1D:
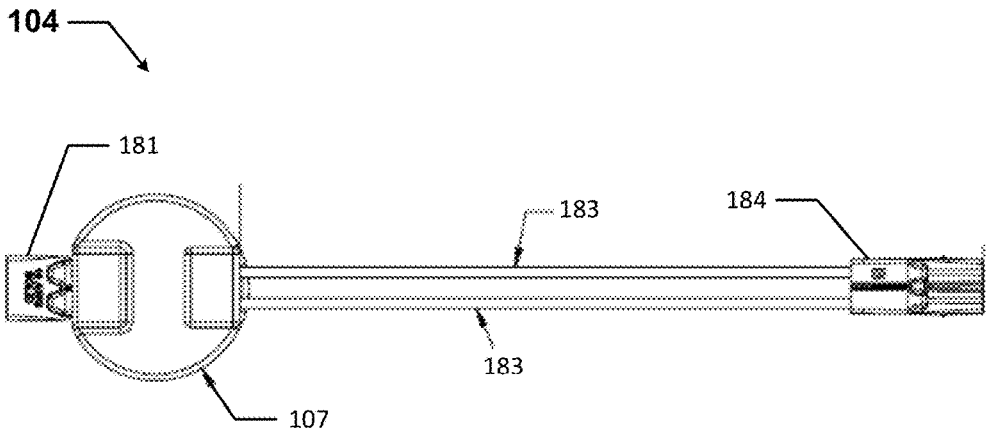
Figure 1E:
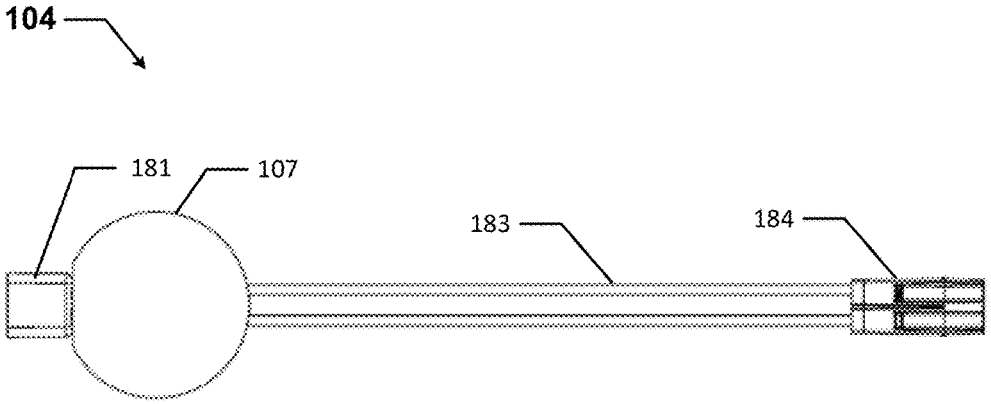

FIGS. 1A-1E show various views of an adapter 104 in accordance with certain example embodiments. Specifically, FIG. 1A shows a top-side perspective view of the adapter 104. FIG. 1B shows a side view of the adapter 104. FIG. 1C shows a front view of the adapter 104. FIG. 1D shows a top view of the adapter 104. FIG. 1E shows a bottom view of the adapter 104. Referring to FIGS. 1A-1E, the adapter 104 can include one or more of a number of components. For example, the adapter 104 in this case includes an adapter housing 107, a first coupling feature 181, a second coupling feature 184, and one or more electrical wires 183.

The adapter housing 107 houses one or more of a number of components therein. Such components are used to convert an existing light fixture that has no or limited means of automatic or remote control by a user to a retrofitted light fixture that can be controlled automatically or remotely by a user. Such components can include, but are not limited to, a controller, a communication module, a timer, an energy metering module, a power module, a storage repository, a hardware processor, a memory, a transceiver, an application interface, and, optionally, a security module. More details about the adapter housing 107 and its components are described in more detail below with respect to FIG. 4.

The coupling feature 181 of the adapter 104 can be any type of coupling feature that both electrically and mechanically couples to a component (e.g., a power source that delivers AC mains or other form of primary power) of an existing light fixture. In this example, the coupling feature 181 is an electrical connector end that is configured to couple to a complementary electrical connector end of an existing light fixture. The coupling feature 181 can be disposed on the adapter housing 107, as shown in FIGS. 1A-1E. Alternatively, the coupling feature 181 can be located remotely from the adapter housing 107. In such a case, the coupling feature 181 can be electrically coupled to the adapter housing 107 (or, more specifically, one or more components within the adapter housing 107) using one or more electrical wires, such as electrical wires 183.

The coupling feature 184 of the adapter 104 can be any type of coupling feature that both electrically and mechanically couples to another component (e.g., a power supply that distributes power to the light sources) of an existing light fixture. In this example, the coupling feature 184 is an electrical connector end that is configured to couple to a complementary electrical connector end of an existing light fixture. The coupling feature 184 can be disposed on the adapter housing 107. Alternatively, as shown in FIGS. 1A-1E, the coupling feature 184 can be located remotely from the adapter housing 107. In such a case, the coupling feature 184 can be electrically coupled to the adapter housing 107 (or, more specifically, one or more components within the adapter housing 107) using one or more electrical wires 183. The electrical wires 183 provide a flexible connection between coupling feature 184 and the adapter housing 107.

In certain example embodiments, coupling feature 184 can be configured as the complement of coupling feature 181. In other words, with the existing light fixture for which the example adapter 104 is used, there can be two coupling features that are coupled to each other. For example, a power supply that delivers AC mains or other form of primary power can have a coupling feature (e.g., an electrical connector end) that is detachably coupled to a complementary coupling feature (e.g., a complementary electrical connector end) of a power supply (e.g., a driver) that manipulates the AC mains or other form of primary power for use by other components (e.g., light sources) of the existing light fixture. In such a case, to accommodate the example adapter 104, such coupling features of the existing light fixture are decoupled from each other, allowing for one coupling feature 181 of the adapter 104 to become coupled to one of those coupling features of the existing light fixture and for the other coupling feature 184 of the adapter 104 to become coupled to the other of those coupling features of the existing light fixture.

In certain example embodiments, one or more coupling features (e.g., adhesive, apertures, tabs) can be disposed on an outer surface of the adapter housing 107 of the adapter 104. In such a case, the adapter housing 107 can be secured within an existing light fixture. Similarly, coupling feature 181 and/or coupling feature 184 can include one or more additional coupling features (e.g., adhesive, apertures, tabs) that can be used to secure such coupling feature within an existing light fixture.

Figure 2:
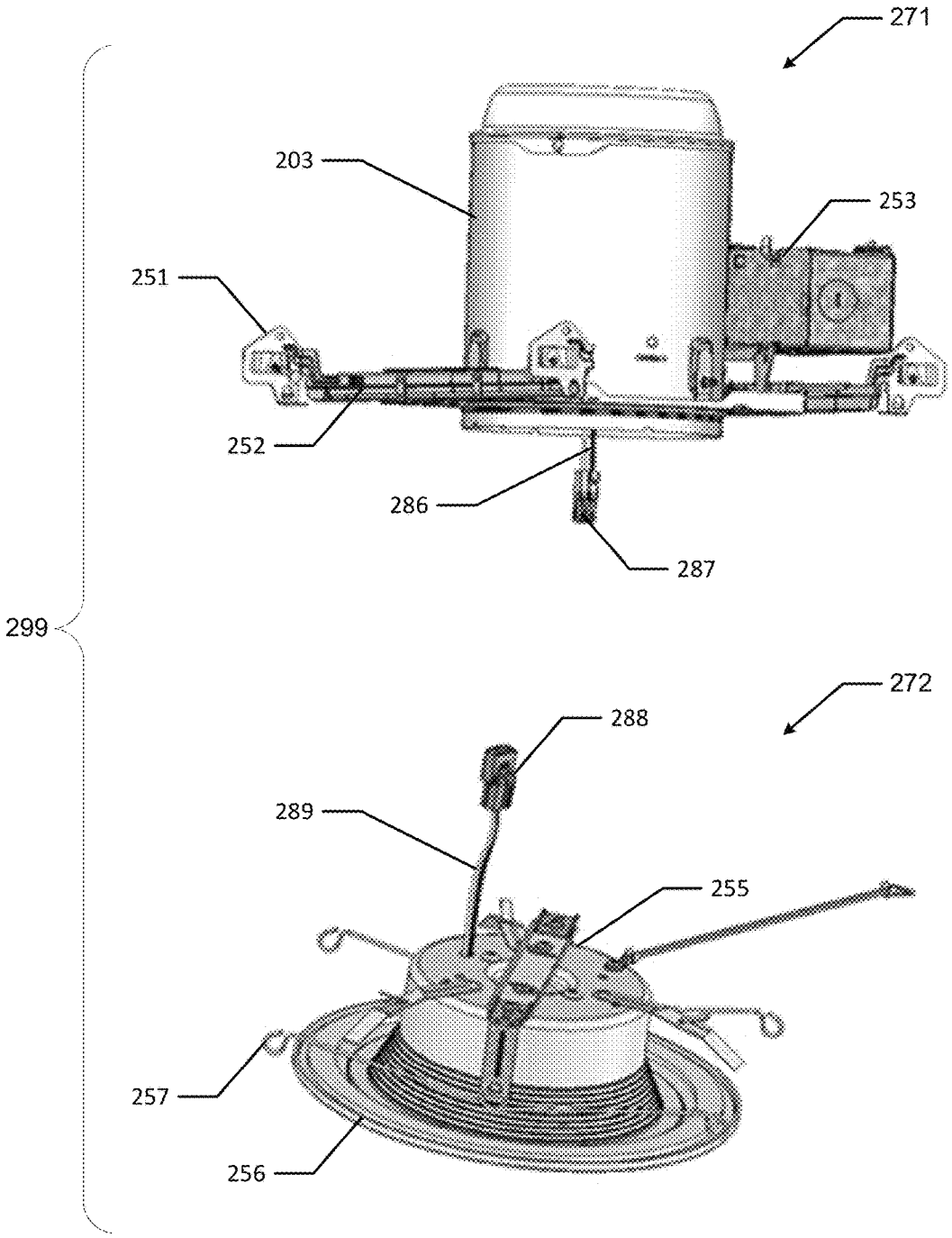
FIG. 2 shows a partially disassembled existing light fixture with which example embodiments can be used.

FIG. 2 shows a partially disassembled existing light fixture 299 with which example embodiments can be used. Referring to FIGS. 1A-2, the existing light fixture 299 of FIG. 2 shows a first portion 271 that is separated (disconnected) from a second portion 272. The first portion 271 of the existing light fixture 299 in this case includes a housing 203, a junction box 253, a plaster frame 252, and mounting brackets 251. Since the second portion 272 of the existing light fixture 299 is separated from the first portion 271, the bottom of the housing 203 is open. This allows for one or more electrical wires 286, disposed within the housing 203, to extend below the housing 203. At the distal end of the electrical wires 286 is disposed a coupling feature 287 (in this case, an electrical connector end). The proximal end of the electrical wires 286 are coupled to a component (e.g., a power source that delivers AC mains or other form of primary power) of the existing light fixture 299.

The second portion 272 of the existing light fixture 299 in this case includes a driver housing 255, a trim assembly 256, and mounting features 257 (in this case, torsion springs) for mechanically securing the second portion 272 of the existing light fixture 299 to the first portion 271. Since the first portion 271 of the existing light fixture 299 is separated from the second portion 272, the top of the driver housing 255 is exposed. As a result, one or more electrical wires 289 are visible. At the proximal end of the electrical wires 289 is disposed a coupling feature 288 (in this case, an electrical connector end). The distal end of the electrical wires 289 are coupled to another component (e.g., a power supply) of the existing light fixture 299 disposed within the driver housing 255.

Coupling feature 287 of the first portion 271 of the existing light fixture 299 complements coupling feature 288 of the second portion 272 of the existing light fixture 299. When the existing light fixture 299 if fully assembled, coupling feature 287 couples to coupling feature 288. When this occurs, coupling feature 287 and coupling feature 288 are both electrically and mechanically coupled to each other.

The existing light fixture 299 in this case is what is referred to as a "dumb" light fixture. In other words, the existing light fixture 299 only receives basic controls (e.g., on, off) from a light switch controlled by a user through physical wires (e.g., electrical wires 286, electrical wires 289). The existing light fixture 299 has no wireless communication capability. Further, the existing light fixture 299 may be lacking the ability to be controlled in one or more other ways (e.g., dimming, operate according to pre-set schedules, execute color tuning on the light emitted by the light sources of the existing light fixture 299).

Figure 3:
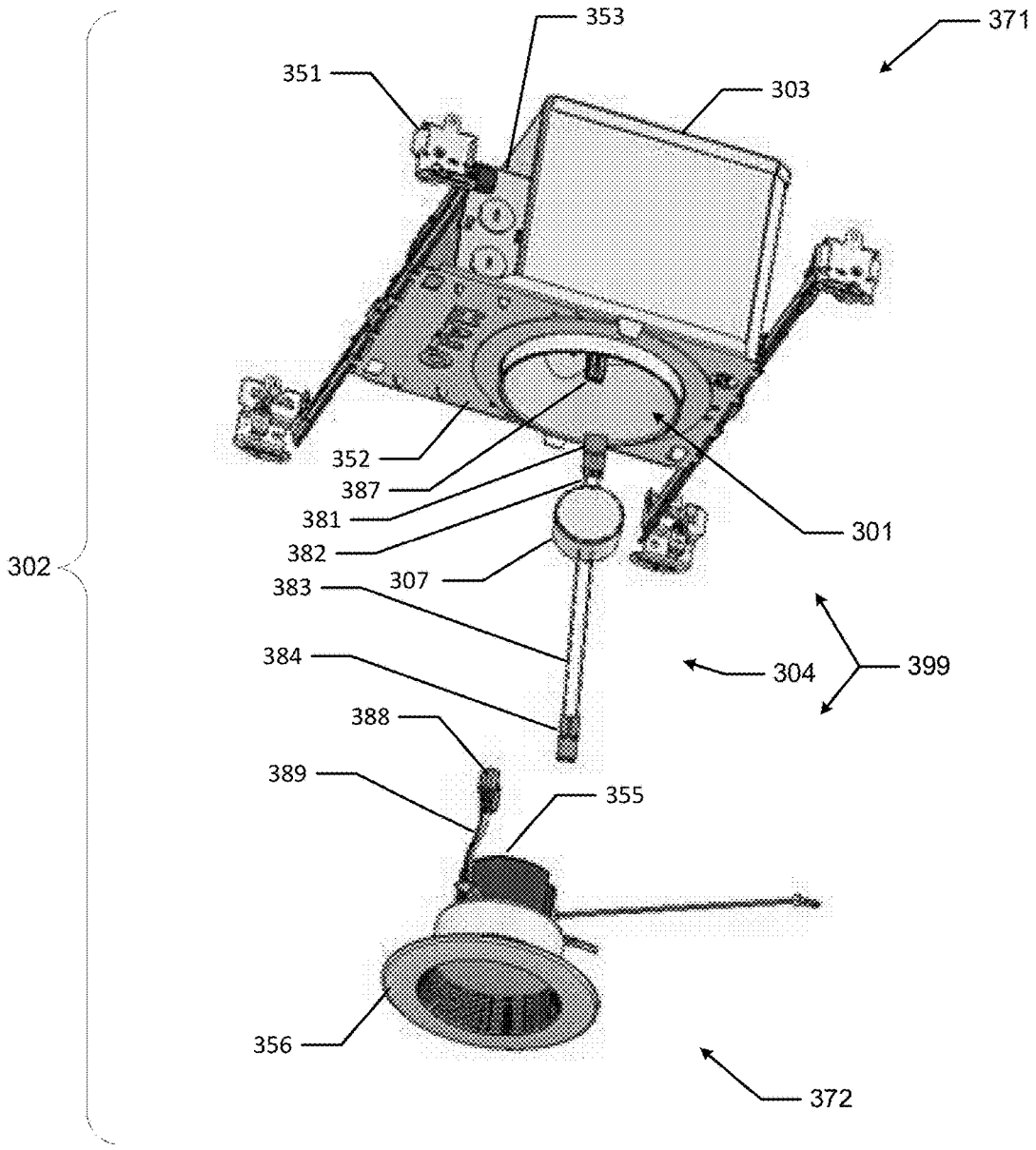
FIG. 3 shows a retrofitted light fixture that includes an existing light fixture and an adapter in accordance with certain example embodiments.

By retrofitting an existing light fixture (e.g., existing light fixture 299) with an example adapter, the resulting "smart" retrofitted light fixture can communicate wirelessly with a user or a master controller. Further, the resulting retrofitted light fixture can have increased operational capability using the example adapter. FIG. 3 shows a retrofitted light fixture 302 that includes an existing light fixture 399 and an adapter 304 in accordance with certain example embodiments.

Referring to FIGS. 1A-3, the existing light fixture 399 of FIG. 3 is substantially similar to the existing light fixture 299 of FIG. 2. For example, the existing light fixture 399 of FIG. 3 has a first portion 371 that is separated (disconnected) from a second portion 372. The first portion 371 of the existing light fixture 399 in this case includes a housing 303, a junction box 353, a plaster frame 352, and mounting brackets 351. Since the second portion 372 of the existing light fixture 399 is separated from the first portion 371, the bottom of the housing 303 is open. This allows for one or more electrical wires (hidden from view but disposed within the cavity 301 formed by the housing 303) to extend within the cavity 301 of the housing 203. At the distal end of those electrical wires is disposed a coupling feature 387 (in this case, an electrical connector end). The proximal end of those electrical wires are coupled to a component (e.g., a power source that delivers AC mains or other form of primary power) of the existing light fixture 399.

The second portion 372 of the existing light fixture 399 in this case includes a driver housing 355 and a trim assembly 356. Since the first portion 371 of the existing light fixture 399 is separated from the second portion 372, the driver housing 355 is exposed. As a result, one or more electrical wires 389 are visible. At the proximal end of the electrical wires 389 is disposed a coupling feature 388 (in this case, an electrical connector end). The distal end of the electrical wires 389 are coupled to another component (e.g., a power supply) of the existing light fixture 399 disposed within the driver housing 355.

Disposed between the first portion 371 of the existing light fixture 399 and the second portion 372 of the existing light fixture 399 is the adapter 304. The adapter 304 of FIG. 3 is substantially similar to the adapter 104 of FIGS. 1A-1E described above. For example, the adapter 304 of FIG. 3 includes an adapter housing 307, a first coupling feature 381, one or more electrical wires 382, a second coupling feature 384, and one or more electrical wires 383. The electrical wires 382 were not present in the adapter 204 of FIG. 2. In this case, the electrical wires 382 provide a flexible connection between coupling feature 381 and the adapter housing 307.

As discussed above, coupling feature 384 can be configured as the complement of coupling feature 381. In other words, since coupling feature 387 and coupling feature 388 of the "dumb" existing light fixture 399 would normally couple to each other, to create the "smart" retrofitted light fixture 302, coupling feature 387 of the first portion 371 of the existing light fixture 399 couples to coupling feature 381 of the example adapter 304, and coupling feature 388 of the first portion 372 of the existing light fixture 399 couples to coupling feature 384 of the example adapter 304.

When portion 372 is recoupled to portion 371, the adapter 304 is disposed within the cavity 301 of the housing 303 of the resulting retrofitted light fixture 302. As discussed above, one or more coupling features (e.g., adhesive, apertures, tabs) can be disposed on an outer surface of the adapter housing 307, coupling feature 381, and/or coupling feature 384 of the adapter 304 to secure one or more portions of the adapter 304 within the cavity 301 of the housing 303 of the retrofitted light fixture 302.

Figure 4:
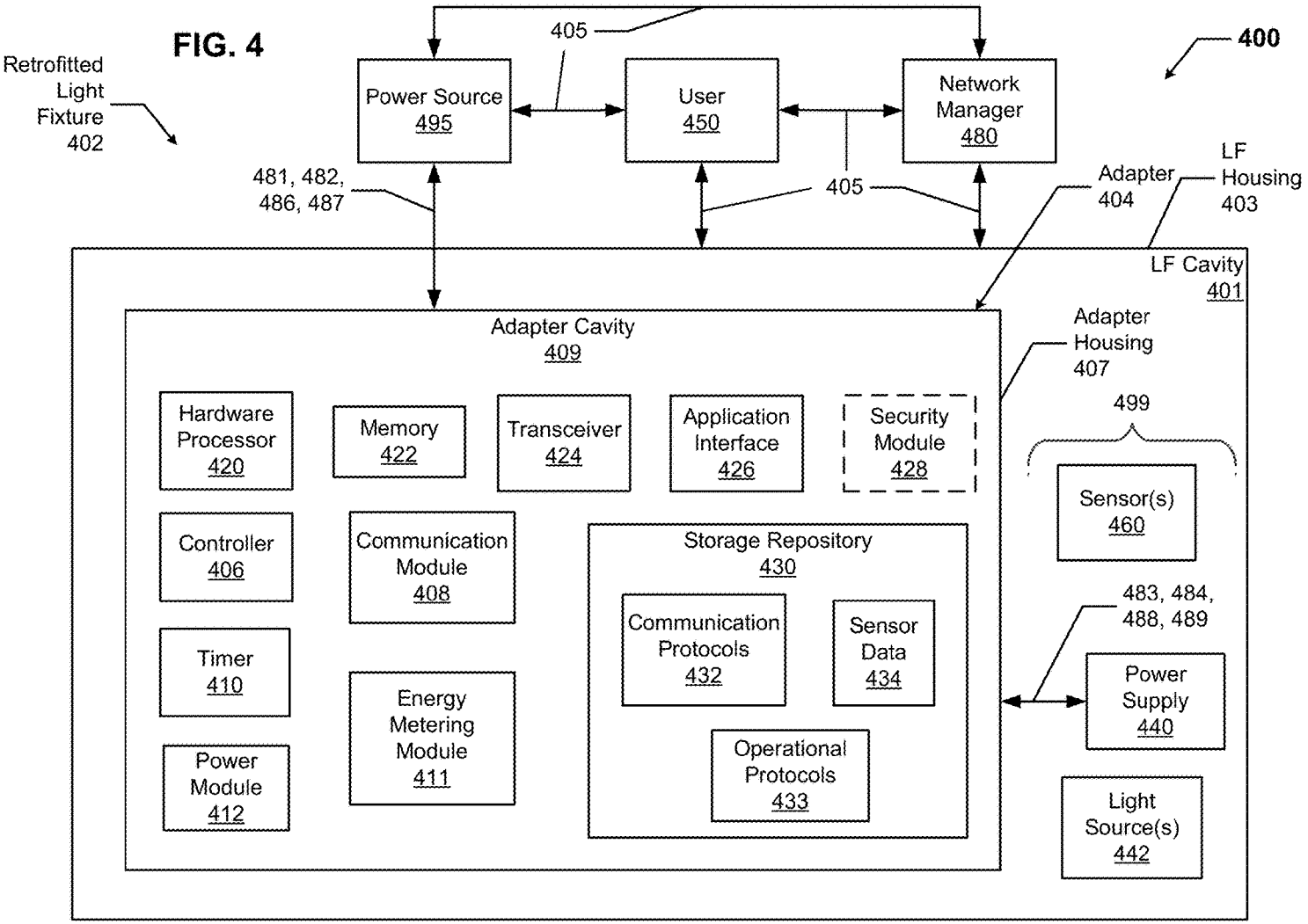
FIG. 4 shows a system diagram of a lighting system that includes a retrofitted light fixture in accordance with certain example embodiments.

FIG. 4 shows a system diagram of a lighting system 400 that includes an example adapter 404 of a retrofitted light fixture 402 in accordance with certain example embodiments. The lighting system 400 can include a power source 495, a user 450, a network manager 480, and the retrofitted light fixture 402. In addition to the adapter 404, the retrofitted light fixture 402 can include the components of the exiting light fixture 499, such as a power supply 440, a number of light sources 442, and one or more sensors 460.

The adapter 404 can include one or more of a number of components. Such components, can include, but are not limited to, a controller 406, a communication module 408, a timer 410, an energy metering module 411, a power module 412, a storage repository 430, a hardware processor 420, a memory 422, a transceiver 424, an application interface 426, and, optionally, a security module 428. The components shown in FIG. 4 are not exhaustive, and in some embodiments, one or more of the components shown in FIG. 4 may not be included in an example light fixture. Any component of the example retrofitted light fixture 402 can be discrete or combined with one or more other components of the retrofitted light fixture 402.

The user 450 is the same as a user defined above. The user 450 can use a user system (not shown), which may include a display (e.g., a GUI). The user 450 interacts with (e.g., sends data to, receives data from) the adapter 404 of the retrofitted light fixture 402 via the application interface 426 (described below). The user 450 can also interact with a network manager 480, the power source 495, and/or one or more of the sensors 460. Interaction between the user 450, the retrofitted light fixture 402, the network manager 480, and the sensors 460 is conducted using communication links 405. Each communication link 405 can include wired (e.g., Class 1 electrical cables, Class 2 electrical cables, electrical connectors) and/or wireless (e.g., Wi-Fi, visible light communication, cellular networking, Bluetooth, Bluetooth Low Energy (BLE), Zigbee, WirelessHART, ISA100, Power Line Carrier, RS485, DALI) technology. For example, a communication link 405 can be (or include) a wireless link between the adapter 404 and the user 450. The communication link 405 can transmit signals (e.g., power signals, communication signals, control signals, data) between the retrofitted light fixture 402 and the user 450, the power source 495, the network manager 480, and/or one or more of the sensors 460.

The network manager 480 is a device or component that controls all or a portion (e.g., a communication network) of the system 400 that includes the adapter 404 of the retrofitted light fixture 402, the power source 495, the user 450, and the sensors 460. The network manager 480 can be substantially similar to the adapter 404, or portions thereof, as described below. For example, the network manager 480 can include a controller. Alternatively, the network manager 480 can include one or more of a number of features in addition to, or altered from, the features of the adapter 404 described below. As described herein, communication with the network manager 480 can include communicating with one or more other components (e.g., another light fixture) of the system 400. In such a case, the network manager 480 can facilitate such communication.

The power source 495 of the system 400 provides AC mains or other form of primary power to the retrofitted light fixture 402, as well as to one or more other components (e.g., the network manager 480) of the system 400. The power source 495 can include one or more of a number of components. Examples of such components can include, but are not limited to, an electrical wire (e.g., electrical wire 486), a coupling feature (e.g., coupling feature 487), a transformer, an inductor, a resistor, a capacitor, a diode, a transistor, and a fuse. The power source 495 can be, or include, for example, a wall outlet, an energy storage device (e.g. a battery, a supercapacitor), a circuit breaker, and an independent source of generation (e.g., a photovoltaic solar generation system). The power source 495 can also include one or more components (e.g., a switch, a relay, a controller) that allow the power source 495 to communicate with and/or follow instructions from the user 450, the adapter 404, and/or the network manager 480.

As discussed above with respect to FIG. 3, the power source 495 can be coupled to the adapter 404. In this case, the power source 495 includes an electrical wire 486, at the distal end of which is disposed coupling feature 487. Adapter 404 includes an electrical wire 482, at the distal end of which his disposed coupling feature 481. Coupling feature 487 and coupling feature 481 are complementary to each other and are detachably coupled to each other. In this way, the AC mains or other form of primary power provided by the power source 495 is delivered directly to the adapter 404.

The one or more sensors 460 can be any type of sensing device that measure one or more parameters. Examples of types of sensors 460 can include, but are not limited to, a passive infrared sensor, a photocell, a differential pressure sensor, a humidity sensor, a pressure sensor, an air flow monitor, a gas detector, and a resistance temperature detector. Parameters that can be measured by a sensor 460 can include, but are not limited to, movement, occupancy, ambient light, infrared light, temperature within the light fixture housing 403, and ambient temperature. The parameters measured by the sensors 460 can be used by the controller 406 of the adapter and/or by one or more components (e.g., the power supply 440) of the existing light fixture 499 to operate the retrofitted light fixture 402.

A sensor 460 can be part of the exiting light fixture 400. In such a case, the controller 406 of the adapter 404 can be configured to communicate with (and in some cases control) the sensor 460. In some other cases, a sensor 460 can be part of the adapter 404 (e.g., disposed within the adapter cavity 409, disposed on the adapter housing 407), where the controller 406 of the adapter 404 can be configured to communicate with (and in some cases control) the sensor 460. As yet another alternative, a sensor 460 can be a new device that is added to the light fixture 400 along with but remotely from the adapter 404, where the controller 406 of the adapter 404 is configured to communicate with (and in some cases control) the sensor 460. Each sensor 460 can use one or more of a number of communication protocols.

The user 450, the network manager 480, the power source 495, and/or the sensors 460 can interact with the adapter 404 of the retrofitted light fixture 402 using the application interface 426 in accordance with one or more example embodiments. Specifically, the application interface 426 of the adapter 404 receives data (e.g., information, communications, instructions, updates to firmware) from and sends data (e.g., information, communications, instructions) to the user 450, the network manager 480, the power source 495, and/or each sensor 460. The user 450, the network manager 480, the power source 495, and/or each sensor 460 can include an interface to receive data from and send data to the adapter 404 in certain example embodiments. Examples of such an interface can include, but are not limited to, a graphical user interface, a touchscreen, an application programming interface, a keyboard, a monitor, a mouse, a web service, a data protocol adapter, some other hardware and/or software, or any suitable combination thereof.

The adapter 404, the user 450, the network manager 480, the power source 495, and/or the sensors 460 can use their own system or share a system in certain example embodiments. Such a system can be, or contain a form of, an Internet-based or an intranet-based computer system that is capable of communicating with various software. A computer system includes any type of computing device and/or communication device, including but not limited to the adapter 404. Examples of such a system can include, but are not limited to, a desktop computer with LAN, WAN, Internet or intranet access, a laptop computer with LAN, WAN, Internet or intranet access, a smart phone, a server, a server farm, an android device (or equivalent), a tablet, smartphones, and a personal digital assistant (PDA). Such a system can correspond to a computer system as described below with regard to FIG. 5.

Further, as discussed above, such a system can have corresponding software (e.g., user software, sensor software, controller software, network manager software). The software can execute on the same or a separate device (e.g., a server, mainframe, desktop personal computer (PC), laptop, PDA, television, cable box, satellite box, kiosk, telephone, mobile phone, or other computing devices) and can be coupled by the communication network (e.g., Internet, Intranet, Extranet, Local Area Network (LAN), Wide Area Network (WAN), or other network communication methods) and/or communication channels, with wire and/or wireless segments according to some example embodiments. The software of one system can be a part of, or operate separately but in conjunction with, the software of another system within the system 400.

The retrofitted light fixture 402 can include a light fixture housing 403, which is substantially the same as the housing of the existing light fixture, and which is substantially the same as the housing 203 of FIG. 2 and the housing 303 of FIG. 3 above. The light fixture housing 403 (also sometimes abbreviated LF housing 403) can include at least one wall that forms a light fixture cavity 401 (also sometimes abbreviated LF cavity 401). In some cases, the light fixture housing 403 can be designed to comply with any applicable standards so that the retrofitted light fixture 402 can be located in a particular environment. The light fixture housing 403 can form any type of retrofitted light fixture 402, including but not limited to a troffer light fixture, a down can light fixture, a recessed light fixture, and a pendant light fixture. The light fixture housing 403 can also be used to combine the retrofitted light fixture 402 with some other device, including but not limited to a ceiling fan, a smoke detector, a broken glass detector, a garage door opener, and a wall clock.

The light fixture housing 403 of the retrofitted light fixture 402 can be used to house one or more components of the retrofitted light fixture 402, including the adapter 404. For example, as shown in FIG. 4, the adapter 404 (which in this case includes the controller 406, the communication module 408, the timer 410, the energy metering module 411, the power module 412, the storage repository 430, the hardware processor 420, the memory 422, the transceiver 424, the application interface 426, and the optional security module 428), the sensors 460, the power supply 440, and the light sources 442 are disposed in the light fixture cavity 401 formed by the housing 403. In alternative embodiments, any one or more of these or other components (e.g., a sensor 460) of the retrofitted light fixture 402 can be disposed on the light fixture housing 403 and/or remotely from, but in communication with, the light fixture housing 403.

Similarly, the adapter 404 can include an adapter housing 407, which is substantially the same as the adapter housing described above with respect to FIGS. 1A-3. The adapter housing 407 can include at least one wall that forms an adapter cavity 409. One or more of the various components (e.g., controller 406, hardware processor 420) of the adapter 404 can be disposed within the adapter cavity 409. Alternatively, a component of the adapter 404 can be disposed on the adapter housing 407 or can be located remotely from, but in communication with, the adapter housing 407.

The storage repository 430 can be a persistent storage device (or set of devices) that stores software and data used to assist the adapter 404 in communicating with the user 450, the network manager 480, the power source 495, and one or more sensors 460 within the system 400. In one or more example embodiments, the storage repository 430 stores one or more communication protocols 432, operational protocols 433, and sensor data 434. The communication protocols 432 can be any of a number of protocols that are used to send and/or receive data between the adapter 404 and the user 450, the network manager 480, the power source 495, and one or more sensors 460. One or more of the communication protocols 432 can be a time-synchronized protocol. Examples of such time-synchronized protocols can include, but are not limited to, a highway addressable remote transducer (HART) protocol, a wirelessHART protocol, and an International Society of Automation (ISA) 100 protocol. In this way, one or more of the communication protocols 432 can provide a layer of security to the data transferred within the system 400.

The operational protocols 433 can be any algorithms, formulas, logic steps, and/or other similar operational procedures that the controller 406 of the adapter 404 follows based on certain conditions at a point in time. An example of an operational protocol 433 is directing the controller 406 to provide power and to cease providing power to the power supply 440 at pre-set points of time. Another example of an operational protocol 433 is directing the controller 406 to adjust the amount of power delivered to the power supply 440, thereby acting as a dimmer. Yet another example of an operational protocol 433 is to instruct the controller 406 how and when to tune the color output by one or more of the light sources 442 of the retrofitted light fixture 402. Still another example of an operational protocol 433 is to check one or more communication links 405 with the network manager 480 and, if a communication link 405 is not functioning properly, allow the adapter 404 to operate autonomously from the rest of the system 400.

As another example of an operational protocol 433, configurations of the adapter 404 can be stored in memory 422 (e.g., non-volatile memory) so that the adapter 404 (or portions thereof) can operate regardless of whether the adapter 404 is communicating with the network manager 480 and/or other components in the system 400. Still another example of an operational protocol 433 is identifying an adverse condition or event (e.g., excessive humidity, no pressure differential, extreme pressure differential, high temperature) based on measurements taken by a sensor 460. In such a case, the controller 404 can notify the network manager 480 and/or the user 450 as to the adverse condition or event identified. Yet another example of an operational protocol 433 is to have the adapter 404 operate in an autonomous control mode if one or more components (e.g., the communication module 408, the transceiver 424) of the adapter 404 that allows the adapter 404 to communicate with another component of the system 400 fails.

Sensor data 434 can be any data associated with (e.g., collected by) each sensor 460 that is communicably coupled to the adapter 404. Such data can include, but is not limited to, a manufacturer of the sensor 460, a model number of the sensor 460, communication capability of a sensor 460, power requirements of a sensor 460, and measurements taken by the sensor 460. Examples of a storage repository 430 can include, but are not limited to, a database (or a number of databases), a file system, a hard drive, flash memory, some other form of solid state data storage, or any suitable combination thereof. The storage repository 430 can be located on multiple physical machines, each storing all or a portion of the communication protocols 432, the operational protocols 433, and/or the sensor data 434 according to some example embodiments. Each storage unit or device can be physically located in the same or in a different geographic location.

The storage repository 430 can be operatively connected to the controller 406. In one or more example embodiments, the controller 406 includes functionality to communicate with the user 450, the network manager 480, the power source 495, and the sensors 460 in the system 400. More specifically, the controller 406 sends information to and/or receives information from the storage repository 430 in order to communicate with the user 450, the network manager 480, the power source 495, and the sensors 460. As discussed below, the storage repository 430 can also be operatively connected to the communication module 408 in certain example embodiments.

In certain example embodiments, the controller 406 of the adapter 404 controls the operation of one or more components (e.g., the communication module 408, the timer 410, the transceiver 424) of the adapter 404. For example, the controller 406 can activate the communication module 408 when the communication module 408 is in "sleep" mode and when the communication module 408 is needed to send data received from another component (e.g., a sensor 460, the user 450) in the system 400. As another example, the controller 406 can operate one or more sensors 460 to dictate when measurements are taken by the sensors 460 and when those measurements are communicated by the sensors 460 to the controller 406. As another example, the controller 406 can acquire the current time using the timer 410. The timer 410 can enable the adapter 404 to control the retrofitted light fixture 402 even when the adapter 404 has no communication with the network manager 480.

As another example, the controller 406 can check one or more communication links 405 between the adapter 404 and the network manager 480 and, if a communication link 405 is not functioning properly, allow the adapter 404 to operate autonomously from the rest of the system 400. As yet another example, the controller 406 can store configurations of the adapter 404 (or portions thereof) in memory 422 (e.g., non-volatile memory) so that the adapter 404 (or portions thereof) can operate regardless of whether the adapter 404 is communicating with the network controller 480 and/or other components in the system 400.

As still another example, the controller 406 can obtain readings from an adjacent sensor if the sensor 460 associated with the retrofitted light fixture 402 malfunctions, if the communication link 405 between the sensor 460 and the adapter 404 fails, and/or for any other reason that the readings of the sensor 460 associated with the retrofitted light fixture 402 fails to reach the adapter 404. To accomplish this, for example, the network manager 480 can instruct, upon a request from the controller 406, the adjacent sensor 460 to communicate its readings to the controller 406 of the adapter 404 using communication links 405. As still another example, the controller 406 can cause the adapter 404 to operate in an autonomous control mode if one or more components (e.g., the communication module 408, the transceiver 424) of the adapter 404 that allows the adapter 404 to communicate with another component of the system 400 fails. Similarly, the controller 406 of the adapter 404 can control at least some of the operation of one or more adjacent light fixtures in the system 400.

The controller 406 can provide control, communication, and/or other similar signals to the user 450, the network manager 480, and one or more of the sensors 460. Similarly, the controller 406 can receive control, communication, and/or other similar signals from the user 450, the network manager 480, the power source 495, and one or more of the sensors 460. The controller 406 can control each sensor 460 automatically (for example, based on one or more algorithms stored in the storage repository 430) and/or based on control, communication, and/or other similar signals received from another device through a communication link 405. The controller 406 may include a printed circuit board, upon which the hardware processor 420 and/or one or more discrete components of the adapter 404 are positioned.

In certain example embodiments, the controller 406 can include an interface that enables the controller 406 to communicate with one or more components (e.g., power supply 440) of the retrofitted light fixture 402. For example, if the power supply 440 of the retrofitted light fixture 402 operates under IEC Standard 62386, then the power supply 440 can include a digital addressable lighting interface (DALI). In such a case, the controller 406 can also include a DALI to enable communication with the power supply 440 within the retrofitted light fixture 402. Such an interface can operate in conjunction with, or independently of, the communication protocols 432 used to communicate between the adapter 404 and the user 450, the network manager 480, the power source 495, and the sensors 460.

The controller 406 (or other components of the adapter 404) can also include one or more hardware components and/or software elements to perform its functions. Such components can include, but are not limited to, a universal asynchronous receiver/transmitter (UART), a serial peripheral interface (SPI), a direct-attached capacity (DAC) storage device, an analog-to-digital converter, an inter-integrated circuit ($I^2C$), and a pulse width modulator (PWM).

The communication module 408 of the adapter 404 determines and implements the communication protocol (e.g., from the communication protocols 432 of the storage repository 430) that is used when the controller 406 communicates with (e.g., sends signals to, receives signals from) the user 450, the network manager 480, the power source 495, and/or one or more of the sensors 460. In some cases, the communication module 408 accesses the sensor data 434 to determine which communication protocol is used to communicate with the sensor 460 associated with the sensor data 434. In addition, the communication module 408 can interpret the communication protocol of a communication received by the adapter 404 so that the controller 406 can interpret the communication.

The communication module 408 can send and receive data between the network manager 480, the power source 495, and/or the users 450 and the adapter 404. The communication module 408 can send and/or receive data in a given format that follows a particular communication protocol 432. The controller 406 can interpret the data packet received from the communication module 408 using the communication protocol 432 information stored in the storage repository 430. The controller 406 can also facilitate the data transfer between one or more sensors 460 and the network manager 480, the power source 495, and/or a user 450 by converting the data into a format understood by the communication module 408.

The communication module 408 can send data (e.g., communication protocols 432, operational protocols 433, sensor data 434, operational information, error codes, threshold values, algorithms) directly to and/or retrieve data directly from the storage repository 430. Alternatively, the controller 406 can facilitate the transfer of data between the communication module 408 and the storage repository 430. The communication module 408 can also provide encryption to data that is sent by the adapter 404 and decryption to data that is received by the adapter 404. The communication module 408 can also provide one or more of a number of other services with respect to data sent from and received by the adapter 404. Such services can include, but are not limited to, data packet routing information and procedures to follow in the event of data interruption.

The timer 410 of the adapter 404 can track clock time, intervals of time, an amount of time, and/or any other measure of time. The timer 410 can also count the number of occurrences of an event, whether with or without respect to time. Alternatively, the controller 406 can perform the counting function. The timer 410 is able to track multiple time measurements concurrently. The timer 410 can track time periods based on an instruction received from the controller 406, based on an instruction received from the user 450, based on an instruction programmed in the software for the adapter 404, based on some other condition or from some other component, or from any combination thereof.

The timer 410 can be configured to track time when there is no power delivered to the adapter 404 (e.g., the power module 412 malfunctions) using, for example, a super capacitor or a battery backup. In such a case, when there is a resumption of power delivery to the adapter 404, the timer 410 can communicate any aspect of time to the adapter 404. In such a case, the timer 410 can include one or more of a number of components (e.g., a super capacitor, an integrated circuit) to perform these functions.

The energy metering module 411 of the adapter 404 measures one or more components of power (e.g., current, voltage, resistance, VARs, watts) at one or more points (e.g., coupling feature 481 of the adapter 404, coupling feature 484 of the adapter, output of the power supply 440) associated with the retrofitted light fixture 402. The energy metering module 411 can include any of a number of measuring devices and related devices, including but not limited to a voltmeter, an ammeter, a power meter, an ohmmeter, a current transformer, a potential transformer, and electrical wiring. The energy metering module 411 can measure a component of power continuously, periodically, based on the occurrence of an event, based on a command received from the controller 406, and/or based on some other factor.

The power module 412 of the adapter 404 provides power to one or more other components (e.g., timer 410, controller 406) of the adapter 404. In addition, in certain example embodiments, the power module 412 can provide power to the power supply 440 of the retrofitted light fixture 402. The power module 412 can include one or more of a number of single or multiple discrete components (e.g., transistor, diode, resistor), and/or a microprocessor. The power module 412 may include a printed circuit board, upon which the microprocessor and/or one or more discrete components are positioned. In some cases, the power module 412 can include one or more components that allow the power module 412 to measure one or more elements of power (e.g., voltage, current) that is delivered to and/or sent from the power module 412.

The power module 412 can include one or more components (e.g., a transformer, a diode bridge, an inverter, a converter) that receives power (e.g., AC mains) from the power source 495 and/or some other source of power (e.g., external to the retrofitted light fixture 402). The power module 412 can use this power to generate power of a type (e.g., alternating current, direct current) and level (e.g., 12V, 24V, 120V) that can be used by the other components of the adapter 404 and the power supply 440. In addition, or in the alternative, the power module 412 can be a source of power in itself to provide signals to the other components of the adapter 404 and/or the power supply 440. For example, the power module 412 can be a battery or other form of energy storage device. As another example, the power module 412 can be a localized photovoltaic solar power system.

In certain example embodiments, the power module 412 of the adapter 404 can also provide power and/or control signals, directly or indirectly, to one or more of the sensors 460. In such a case, the controller 406 can direct the power generated by the power module 412 to the sensors 460 and/or the power supply 440 of the retrofitted light fixture 402. In this way, power can be conserved by sending power to the sensors 460 and/or the power supply 440 of the retrofitted light fixture 402 when those devices need power, as determined by the controller 406.

The hardware processor 420 of the adapter 404 executes software, algorithms, and firmware in accordance with one or more example embodiments. Specifically, the hardware processor 420 can execute software on the controller 406 or any other portion of the adapter 404, as well as software used by the user 450, the network manager 480, the power source 495, and/or one or more of the sensors 460. The hardware processor 420 can be an integrated circuit, a central processing unit, a multi-core processing chip, SoC, a multi-chip module including multiple multi-core processing chips, or other hardware processor in one or more example embodiments. The hardware processor 420 is known by other names, including but not limited to a computer processor, a microprocessor, and a multi-core processor.

In one or more example embodiments, the hardware processor 420 executes software instructions stored in memory 422. The memory 422 includes one or more cache memories, main memory, and/or any other suitable type of memory. The memory 422 can include volatile and/or non-volatile memory. The memory 422 is discretely located within the adapter 404 relative to the hardware processor 420 according to some example embodiments. In certain configurations, the memory 422 can be integrated with the hardware processor 420.

In certain example embodiments, the adapter 404 does not include a hardware processor 420. In such a case, the adapter 404 can include, as an example, one or more field programmable gate arrays (FPGA), one or more insulated-gate bipolar transistors (IGBTs), and/or one or more integrated circuits (ICs). Using FPGAs, IGBTs, ICs, and/or other similar devices known in the art allows the adapter 404 (or portions thereof) to be programmable and function according to certain logic rules and thresholds without the use of a hardware processor. Alternatively, FPGAs, IGBTs, ICs, and/or similar devices can be used in conjunction with one or more hardware processors 420.

The transceiver 424 of the adapter 404 can send and/or receive control and/or communication signals. Specifically, the transceiver 424 can be used to transfer data between the adapter 404 and the user 450, the network manager 480, the power source 495, and/or the sensors 460. The transceiver 424 can use wired and/or wireless technology. The transceiver 424 can be configured in such a way that the control and/or communication signals sent and/or received by the transceiver 424 can be received and/or sent by another transceiver that is part of the user 450, the network manager 480, the power source 495, and/or the sensors 460. The transceiver 424 can use any of a number of signal types, including but not limited to radio frequency signals and visible light signals.

When the transceiver 424 uses wireless technology, any type of wireless technology can be used by the transceiver 424 in sending and receiving signals. Such wireless technology can include, but is not limited to, Wi-Fi, visible light communication, cellular networking, BLE, Zigbee, and Bluetooth. The transceiver 424 can use one or more of any number of suitable communication protocols (e.g., ISA100, HART) when sending and/or receiving signals. Such communication protocols can be stored in the communication protocols 432 of the storage repository 430. Further, any transceiver information for the user 450, the network manager 480, the power source 495, and/or the sensors 460 can be part of the communication protocols 432 (or other areas) of the storage repository 430.

Optionally, in one or more example embodiments, the security module 428 secures interactions between the adapter 404, the user 450, the network manager 480, the power source 495, and/or the sensors 460. More specifically, the security module 428 authenticates communication from software based on security keys verifying the identity of the source of the communication. For example, user software may be associated with a security key enabling the software of the user 450 to interact with the adapter 404. Further, the security module 428 can restrict receipt of information, requests for information, and/or access to information in some example embodiments.

As mentioned above, aside from the adapter 404 and its components, the retrofitted light fixture 402 can include one or more sensors 460, a power supply 440, and one or more light sources 442. The sensors 460 are described above. The light sources 442 of the retrofitted light fixture 402 are devices and/or components typically found in a light fixture to allow the retrofitted light fixture 402 to operate. The light sources 442 emit light using power provided by the power supply 440. The retrofitted light fixture 402 can have one or more of any number and/or type (e.g., light-emitting diode, incandescent, fluorescent, halogen) of light sources 442. A light source 442 can vary in the amount and/or color of light that it emits.

The power supply 440 of the retrofitted light fixture 402 receives power (also called primary power) from the power source 495 via the adapter 404. The power supply 440 uses the power it receives to generate and provide power (also called final power herein) to the sensors 460 and/or one or more of the light sources 442. The power supply 440 can be called by any of a number of other names, including but not limited to a driver, a LED driver, and a ballast. The power supply 440 can include one or more of a number of single or multiple discrete components (e.g., transistor, diode, resistor), and/or a microprocessor. The power supply 440 may include a printed circuit board, upon which the microprocessor and/or one or more discrete components are positioned.

In some cases, the power supply 440 can include one or more components (e.g., a transformer, a diode bridge, an inverter, a converter) that receives power from the adapter 404 and generates power of a type (e.g., alternating current, direct current) and level (e.g., 12V, 24V, 120V) that can be used by sensors 460 and/or the light sources 442. In addition, or in the alternative, the power supply 440 can be a source of power in itself. For example, the power supply 440 can or include be a battery, a localized photovoltaic solar power system, or some other source of independent power.

In order to receive power from the adapter 404, as discussed above, the power supply 440 can include one or more electrical wires 489 with a coupling feature 488 disposed at a distal end of the electrical wires 489. The coupling feature 488 of the power supply 440 can be, for example, an electrical connector end that couples to a complementary coupling feature 484 (e.g., a complementary connector end) of the adapter 440. There can also be one or more electrical wires 483 that electrically couple the coupling feature 484 of the adapter 440 to the adapter housing 407 of the adapter 404.

The retrofit light fixture 402 (part of the existing light fixture 499 before being retrofitted) can also include one or more of a number of other components. Examples of such other components can include, but are not limited to, a heat sink, an electrical conductor or electrical cable, a terminal block, a lens, a diffuser, a reflector, an air moving device, a baffle, and a circuit board.

As stated above, the retrofitted light fixture 402 can be placed in any of a number of environments. In such a case, the housing 403 of the retrofitted light fixture 402 can be configured to comply with applicable standards for any of a number of environments. For example, the retrofitted light fixture 402 can be rated as a Division 1 or a Division 2 enclosure under NEC standards. Similarly, the adapter 404, any of the sensors 460, or other devices communicably coupled to the retrofitted light fixture 402 can be configured to comply with applicable standards for any of a number of environments. For example, a sensor 460 can be rated as a Division 1 or a Division 2 enclosure under NEC standards.

Figure 5:
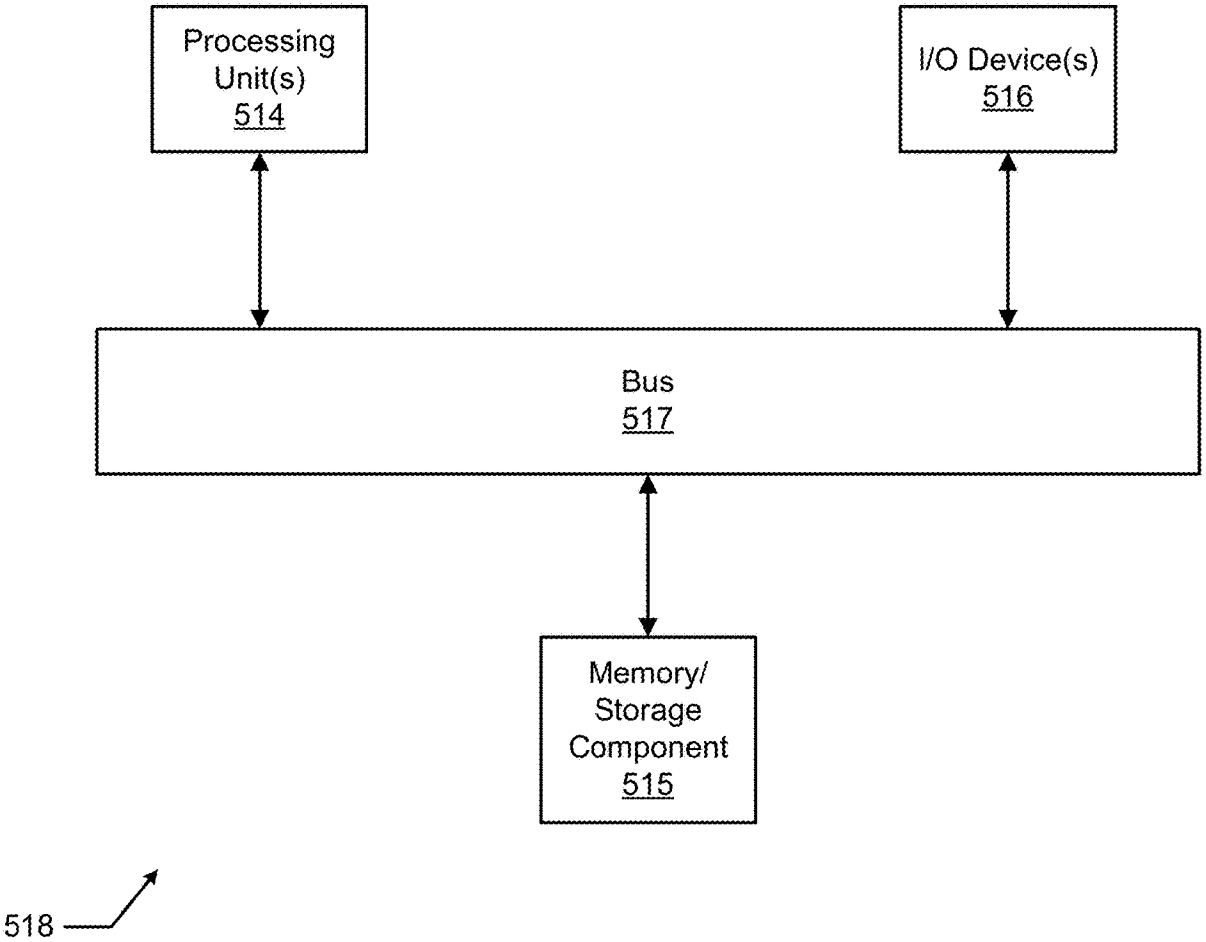
FIG. 5 shows a computing device in accordance with certain example embodiments.

FIG. 5 illustrates one embodiment of a computing device 518 that implements one or more of the various techniques described herein, and which is representative, in whole or in part, of the elements described herein pursuant to certain example embodiments. Computing device 518 is one example of a computing device and is not intended to suggest any limitation as to scope of use or functionality of the computing device and/or its possible architectures. Neither should computing device 518 be interpreted as having any dependency or requirement relating to any one or combination of components illustrated in the example computing device 518.

Computing device 518 includes one or more processors or processing units 514, one or more memory/storage components 515, one or more input/output (I/O) devices 516, and a bus 517 that allows the various components and devices to communicate with one another. Bus 517 represents one or more of any of several types of bus structures, including a memory bus or memory controller, a peripheral bus, an accelerated graphics port, and a processor or local bus using any of a variety of bus architectures. Bus 517 includes wired and/or wireless buses.

Memory/storage component 515 represents one or more computer storage media. Memory/storage component 515 includes volatile media (such as random access memory (RAM)) and/or nonvolatile media (such as read only memory (ROM), flash memory, optical disks, magnetic disks, and so forth). Memory/storage component 515 includes fixed media (e.g., RAM, ROM, a fixed hard drive, etc.) as well as removable media (e.g., a Flash memory drive, a removable hard drive, an optical disk, and so forth).

One or more I/O devices 516 allow a customer, utility, or other user to enter commands and information to computing device 518, and also allow information to be presented to the customer, utility, or other user and/or other components or devices. Examples of input devices include, but are not limited to, a keyboard, a cursor control device (e.g., a mouse), a microphone, a touchscreen, and a scanner. Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 518 is connected to a network (not shown) (e.g., a local area network (LAN), a wide area network (WAN) such as the Internet, cloud, or any other similar type of network) via a network interface connection (not shown) according to some example embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other example embodiments. Generally speaking, the computer system 518 includes at least the minimal processing, input, and/or output means necessary to practice one or more embodiments.

Further, those skilled in the art will appreciate that one or more elements of the aforementioned computer device 518 is located at a remote location and connected to the other elements over a network in certain example embodiments. Further, one or more embodiments is implemented on a distributed system having one or more nodes, where each portion of the implementation (e.g., controller 406) is located on a different node within the distributed system. In one or more embodiments, the node corresponds to a computer system. Alternatively, the node corresponds to a processor with associated physical memory in some example embodiments. The node alternatively corresponds to a processor with shared memory and/or resources in some example embodiments.

Example embodiments of adapters described herein allow a "dumb" existing light fixture that can only be minimally controlled using electrical wires become a "smart" retrofitted light fixture. Example adapters can also prolong the life and functionality of an previously-existing and now-retrofitted light fixture, increase the reliability of the retrofitted light fixture, reduce overall power consumption, improve communication efficiency, have an ease of installation, have an ease of maintenance, and comply with industry standards that apply to light fixtures located in certain environments.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A retrofitted light fixture, comprising:

a coupling feature of a power source that delivers primary power;

at least one light fixture component of an existing light fixture, wherein the at least one light fixture component comprises a power supply, wherein the at least one light fixture component, as part of the existing light fixture, was directly coupled to the power source; and an adapter coupled to the coupling feature of the power source and the power supply of the at least one light fixture component, wherein the adapter comprises a controller and a communication module, wherein the adapter receives the primary power from the coupling feature of the power source, wherein the controller delivers power to the power supply of the at least one light fixture component based on instructions, wherein the communication module allows the controller to communicate with an external component that is external to the retrofitted light fixture, wherein the existing light fixture, without the adapter, continues to operate but is unable to communicate with the external component.

2. The retrofitted light fixture of claim 1, wherein the adapter further comprises a transceiver coupled to the controller and the communication module, wherein the transceiver of the adapter receives the instructions.

3. The retrofitted light fixture of claim 2, wherein the transceiver communicates using wireless communication.

4. The retrofitted light fixture of claim 1, wherein the instructions are stored in the adapter.

5. The retrofitted light fixture of claim 1, wherein the at least one light fixture component comprises a power supply that receives the power from the adapter.

6. The retrofitted light fixture of claim 1, wherein the adapter is disposed within a housing of the existing light fixture.

7. An adapter for retrofitting an existing light fixture, the adapter comprising:

a first coupling feature configured to couple to a power source that provides primary power;

a second coupling feature configured to couple to a power supply of the existing light fixture; and an adapter housing coupled to and disposed between the first coupling feature and the second coupling feature, wherein the adapter housing comprises a controller and a communication module, wherein the controller is configured to:

receive the primary power from the power source through a first connector end; and deliver, using instructions, power based on the primary power to at least one light fixture component of the existing light fixture, wherein the communication module is configured to allow the controller to communicate with an external component that is external to the existing light fixture, and wherein the existing light fixture, without the communication module of the adapter housing, continues to operate but is unable to communicate with the external component.

8. The adapter of claim 7, wherein the first connector end is configured to couple to a first complementary connector end of the power source.

9. The adapter of claim 8, wherein the second coupling feature comprises a second connector end that is configured to couple to a second complementary connector end of the at least one light fixture component.

10. The adapter of claim 9, wherein the second connector end is configured substantially similar to the first complementary connector end of the at least one light fixture component, and wherein the first connector end is configured substantially similar to the second complementary connector end of the power source.

11. The adapter of claim 8, further comprising:

a first electrical wire disposed between the first connector end and the adapter housing, wherein the first electrical wire is configured to transmit the primary power from the first connector end to the adapter housing.

12. The adapter of claim 11, further comprising:

a second electrical wire disposed between the second connector end and the adapter housing, wherein the second electrical wire is configured to transmit the power from the adapter housing to the second connector end.

13. The adapter of claim 7, wherein the adapter housing further comprises a hardware processor and memory coupled to the controller, wherein the hardware processor executes the instructions using the memory.

14. The adapter of claim 13, wherein the adapter housing further comprises a storage repository coupled to the controller, wherein the storage repository stores the instructions.

15. The adapter of claim 7, wherein the adapter housing further comprises a transceiver coupled to the controller, wherein the transceiver receives the instructions from an external source.

16. The adapter of claim 15, wherein the transceiver communicates with the external source using wireless technology.

17. The adapter of claim 7, wherein the adapter housing further comprises a timer coupled to the controller, wherein the instructions are pre-set schedules of operation for the at least one light fixture component, wherein the pre-set schedules are tracked by the timer.

18. The adapter of claim 7, wherein the instructions are for providing the power and ceasing to provide the power to the at least one light fixture component.

19. The adapter of claim 7, wherein the instructions are for providing a reduced amount of the power to the at least one light fixture component.

20. The adapter of claim 7, wherein the instructions are for having a light source of the existing light source emit a particular color, wherein the light source is among the at least one light fixture component.

* * * * *